US007784922B2

(12) United States Patent
Ito

(10) Patent No.: US 7,784,922 B2
(45) Date of Patent: Aug. 31, 2010

(54) LIQUID DROPLET EJECTING APPARATUS

(75) Inventor: Atsushi Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 422 days.

(21) Appl. No.: 12/012,975

(22) Filed: Feb. 6, 2008

(65) Prior Publication Data

US 2008/0186359 A1 Aug. 7, 2008

(30) Foreign Application Priority Data

Feb. 6, 2007 (JP) ..... 2007-027179

(51) Int. Cl.
*B41J 2/045* (2006.01)

(52) U.S. Cl. ..... 347/71

(58) Field of Classification Search ..... 347/71, 347/70, 72, 68–69, 65, 84–85
See application file for complete search history.

(56) References Cited

U.S. PATENT DOCUMENTS 6,840,602 B2 * 1/2005 Watanabe et al. ..... 347/71
7,246,889 B2 * 7/2007 Kanada et al. ..... 347/71
7,594,714 B2 * 9/2009 Katayama ..... 347/68
7,611,231 B2 * 11/2009 Ito ..... 347/71
2005/0122380 A1 6/2005 Nakamura et al.

FOREIGN PATENT DOCUMENTS

JP 2005-161761 6/2005

* cited by examiner

*Primary Examiner*—K. Feggins
(74) *Attorney, Agent, or Firm*—Frommer Lawrence & Haug LLP

(57) ABSTRACT

A liquid droplet ejecting apparatus includes: a plurality of plate members which are laminated with an adhesion layer interposed therebetween; and an ink flow path for an ink, which is formed through the plurality of plate members. The plurality of plate members include: a first plate member which includes a first surface; and a second plate member which is adjacent to the first plate member and includes a second surface facing to the first surface through the adhesion layer. A work of adhesion of the ink to each of the first and second surfaces at a portion surrounding the ink flow path is 0.065 J/m$^2$ or less.

14 Claims, 11 Drawing Sheets

FIG. 7A

WORK OF ADHESION Wa ($\times 10^{-3}$ J/m$^2$)

| | MATERIAL 1 | MATERIAL 2 | MATERIAL 3 |
|---|---|---|---|
| INK 1 | 59.0 | 63.6 | 65.2 |
| INK 2 | 59.8 | 64.9 | 66.3 |
| INK 3 | 56.7 | 65.3 | 68.1 |
| INK 4 | 58.6 | 66.7 | 69.1 |
| AVERAGE | 58.5 | 65.1 | 67.2 |

FIG. 7B

| | DYNAMIC SURFACE TENSION (mN/m) | CONTACT ANGLE (deg) | | |
|---|---|---|---|---|
| | | MATERIAL 1 | MATERIAL 2 | MATERIAL 3 |
| INK 1 | 36.1 | 50.7 | 40.3 | 36.3 |
| INK 2 | 36.3 | 49.7 | 37.9 | 34.3 |
| INK 3 | 35.5 | 53.3 | 33.0 | 23.1 |
| INK 4 | 37.7 | 56.3 | 39.7 | 33.7 |

LIQUID DROPLET EJECTING APPARATUS

CROSS-REFERENCE TO RELATED APPLICATION

This application claims priority from Japanese Patent Application No. 2007-027179, filed on Feb. 6, 2007, the entire subject matter of which is incorporated herein by reference.

TECHNICAL FIELD

Aspects of the present invention relate to a liquid droplet ejecting apparatus which includes a plurality of laminated plate members with adhesion layers interposed therebetween so as to be attached, and has an ink flow path therein.

BACKGROUND

Related-art liquid droplet ejecting apparatuses perform a printing operation on a recording medium by moving a head unit for ejecting ink droplets while facing the recording medium in order to perform a scanning operation. JP-A-2005-161761 describes a head unit which is laminated on a reinforcing plate, and the head unit and the reinforcing plate are attached to a head holder as a set.

FIG. 9 is a diagram illustrating the head unit, the reinforcing plate, and the like included in the related-art ink-jet printing apparatus. FIGS. 10A and 10B are diagrams illustrating a configuration of the head unit and the reinforcing plat shown in FIG. 9. FIG. 10A is a top view illustrating the configuration of the head unit and the reinforcing plate and FIG. 10B is a sectional view illustrating the head unit and the reinforcing plate taken along an arrow XB-XB in FIG. 10A.

A head unit 30 includes a cavity unit 50 includes an ink flow path formed therein and a piezoelectric actuator 40 adhered on the upper surface of the cavity unit 50. As shown in FIG. 10B, the cavity unit 50 has a structure in which eight plate members are laminated and each plate member is adhered to the adjacent plate member with adhesives (not shown). A nozzle plate 38 is disposed in the lowermost portion of the cavity unit 50. The nozzle plate 38 includes a plurality of nozzle rows in which a plurality of nozzles for ejecting ink droplets are arranged. A cavity plate 31 is disposed in the uppermost portion of the cavity unit 50. The cavity plate 31 includes ink supply holes 31*a* to 31*d* and a plurality of pressure chambers for storing ink to be ejected from the nozzles.

The head unit 30 is fixed to the head holder (which is denoted by Reference Numeral 9 in FIG. 3) with the reinforcing plate 60 interposed therebetween. The reinforcing plate 60 is formed so as to have a width larger than that of the head unit 30. The reinforcing plate 60 includes an opening 60*e* for exposing a piezoelectric actuator 40 at the time when the reinforcing plate 60 is adhered to the head unit 30, and ink supply holes 60*a* to 60*d* for supplying ink to the ink supply holes 31*a* to 31*d* of the head unit 30. The reinforcing plate 60 is adhered to the head unit 30 by a thermoplastic sheet-shaped adhesive 2.

The sheet-shaped adhesive 2 is formed in a sheet shape corresponding to a plane shape of the cavity unit 50. The sheet-shaped adhesive includes an opening 2*e* for exposing the piezoelectric actuator 40, and through-holes 2*a* to 2*d* which correspond to the ink supply holes 60*a* to 60*d* of the reinforcing plate 60 and the ink supply holes 31*a* to 31*d* of the head unit 30.

When the reinforcing plate 60 is adhered to the head unit 30 by the sheet-shaped adhesive 2, high adhesive strength is necessary. For this reason, large load and sufficient heat are applied between the reinforcing plate 60 and the head unit 30. Consequently, the sheet-shaped adhesive 2 interposed between the reinforcing plate 60 and the head unit 30 is squeezed so as to become thin, and the high adhesive strength can be obtained and rigidity of the head unit 30 becomes increased.

However, in the related-art ink-jet printing apparatus, the sheet-shaped adhesive 2 between the plate members 60 and 50 surrounding ink flow paths constituted by the ink supply holes 60*a* to 60*d* and the ink supply holes 31*a* to 31*d* is always exposed to ink. Consequently, ink may enter into from an interface 2*i* (FIG. 10B) of the plate members 60 and 50 and the sheet-shaped adhesive 2, thereby detaching the plate members from each other. In particular, if a portion surrounding the ink flow paths in the laminated plates is distorted, a gap between the distorted portion and the adhesion layer is generated. Consequently, ink may enter into the gap, thereby detaching the plate members from each other. Moreover, in the ink-jet printing apparatus which performs a printing operation using a plurality of color ink, entering color ink may be mixed in the ink flow paths, resulting in deteriorating a print quality.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a liquid droplet ejecting apparatus in which it is difficult for ink to enter into an interface of plate members and an adhesive.

According to an exemplary embodiment of the present invention, there is provided a liquid droplet ejecting apparatus including: a plurality of plate members which are laminated with an adhesion layer interposed therebetween; and an ink flow path for an ink, which is formed through the plurality of plate members. The plurality of plate members include: a first plate member which includes a first surface; and a second plate member which is adjacent to the first plate member and includes a second surface facing to the first surface through the adhesion layer. A work of adhesion of the ink to each of the first and second surfaces at a portion surrounding the ink flow path is 0.065 $J/m^2$ or less.

According to another exemplary embodiment of the present invention, there is provided a liquid droplet ejecting apparatus including: a head unit and a reinforcing plate and an ink flow path. The head unit includes: a plurality of nozzles for ejecting ink; and a plurality of pressure chambers which is provided corresponding to the nozzles and which receives force from an actuator unit. The reinforcing plate includes a surface adhered on a surface of the head unit with an adhesion layer interposed therebetween. The ink flow path for the ink, which is formed through the head unit and the reinforcing plate. A work of adhesion of the ink to each of the surface of the head unit and the surface of the reinforcing plate at a portion surrounding the ink flow path is 0.065 $J/m^2$ or less.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIG. 7A is a table showing calculated works of adhesion Wa of inks to the adhesion surfaces of the reinforcing plates;

FIG. 7B is a table showing dynamic surface tensions and contact angles in the inks;

FIG. 10A is a top view illustrating the head unit and the reinforcing plate; and FIG. 10B is a sectional view illustrating the head unit and the reinforcing plate taken along an arrow XB-XB.

DETAILED DESCRIPTION

A liquid droplet ejecting apparatus according to an exemplary embodiment of the present invention will be described with using an ink-jet printing apparatus as an example.

[Overall Configuration]

Figure 1:
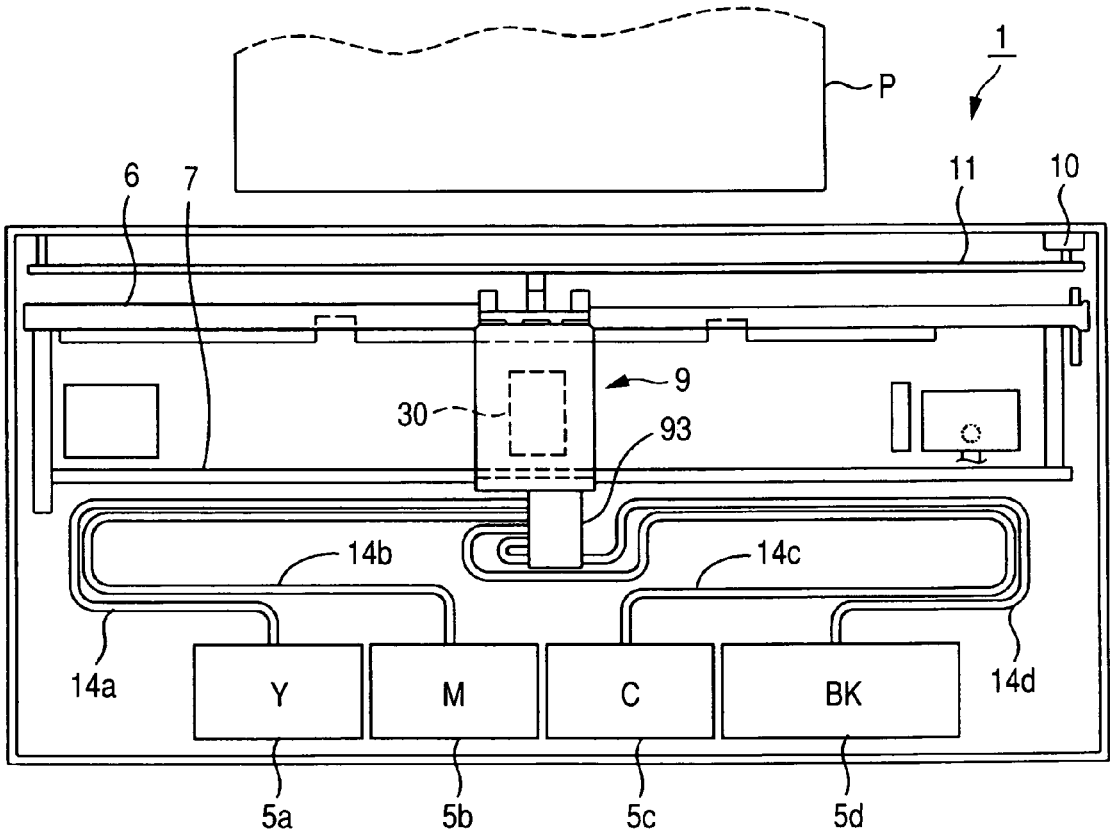
FIG. 1 is a top view for explaining an overall configuration of an ink-jet printing apparatus.

First, components of the ink-jet printing apparatus will be described with reference to FIG. 1. FIG. 1 is a top view for explaining an overall configuration of the ink-jet printing apparatus.

An ink-jet printing apparatus 1 includes: two guide shafts 6 and 7 disposed therein; a head holder 9 which serves as a carriage is arranged on the guide shafts 6 and 7; a head unit 30 which ejects ink on a printing sheet P to perform a printing operation, and which is held by the head holder 9; an endless belt to which the head holder 9 is attached; and a carriage motor 10 which rotates the endless belt. The head holder 9 is moved along the guide shafts 6 and 7 by rotation of the endless belt 11.

The ink-jet printing apparatus further includes an ink tank 5*a* for containing yellow ink, an ink tank 5*b* for containing magenta ink, an ink tank 5*c* for containing cyan ink, an ink tank 5*d* for containing black ink. The ink tanks 5*a* to 5*d* are coupled to flexible ink supplying tubes 14*a* to 14*d*, respectively. Each ink supplied from each ink supplying tube is introduced to the head unit 30 through a tube joint 93 extending outward from the head holder 9. As each ink, pigment ink or dye ink can be used.

[Configuration of Head Unit]

Next, a configuration of the head unit 30 will be described with reference to FIG. 2 to FIG. 5.

Figure 2:
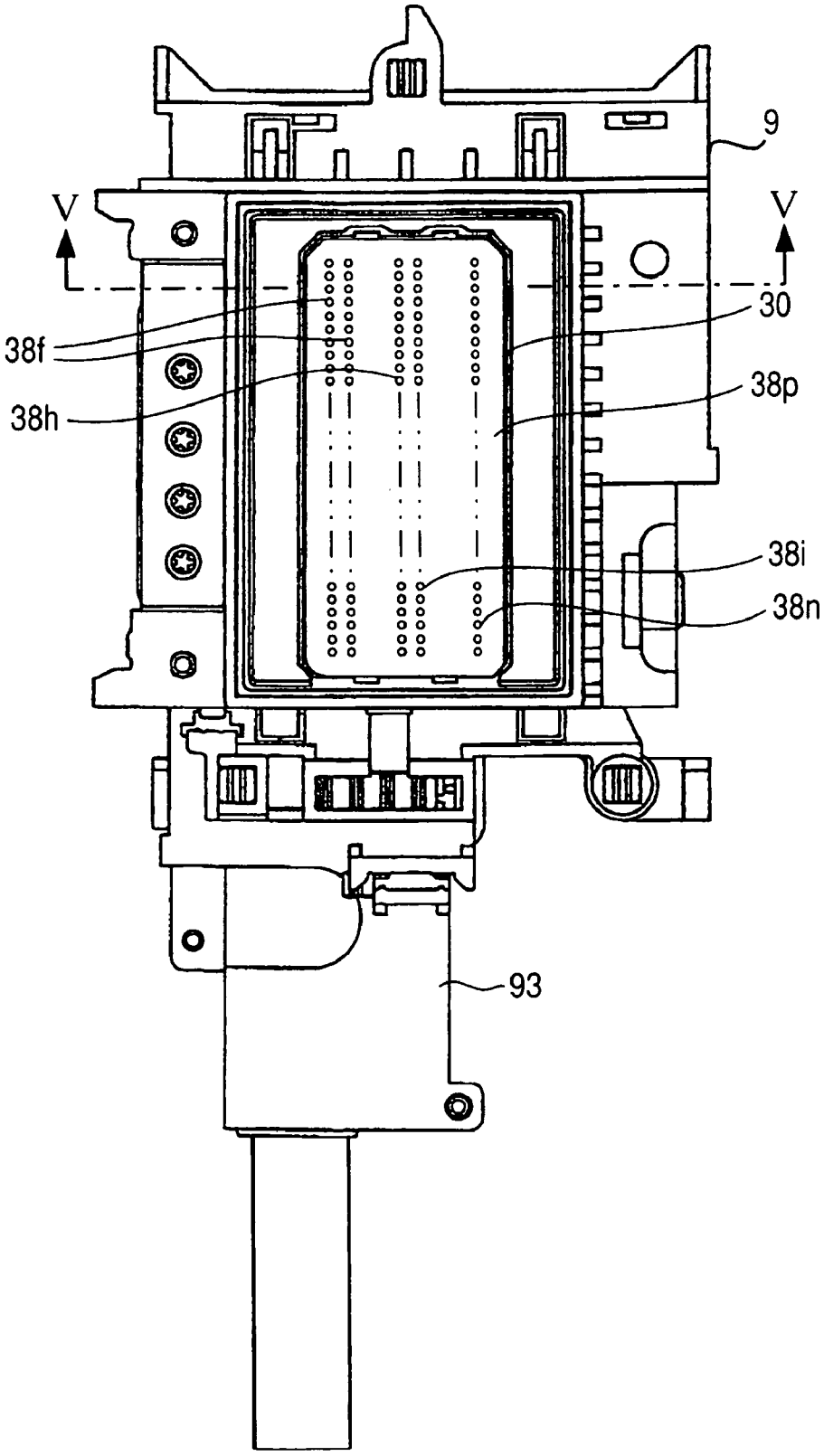
FIG. 2 is a top view illustrating a head holder when viewed from a nozzle surface.
Figure 3:
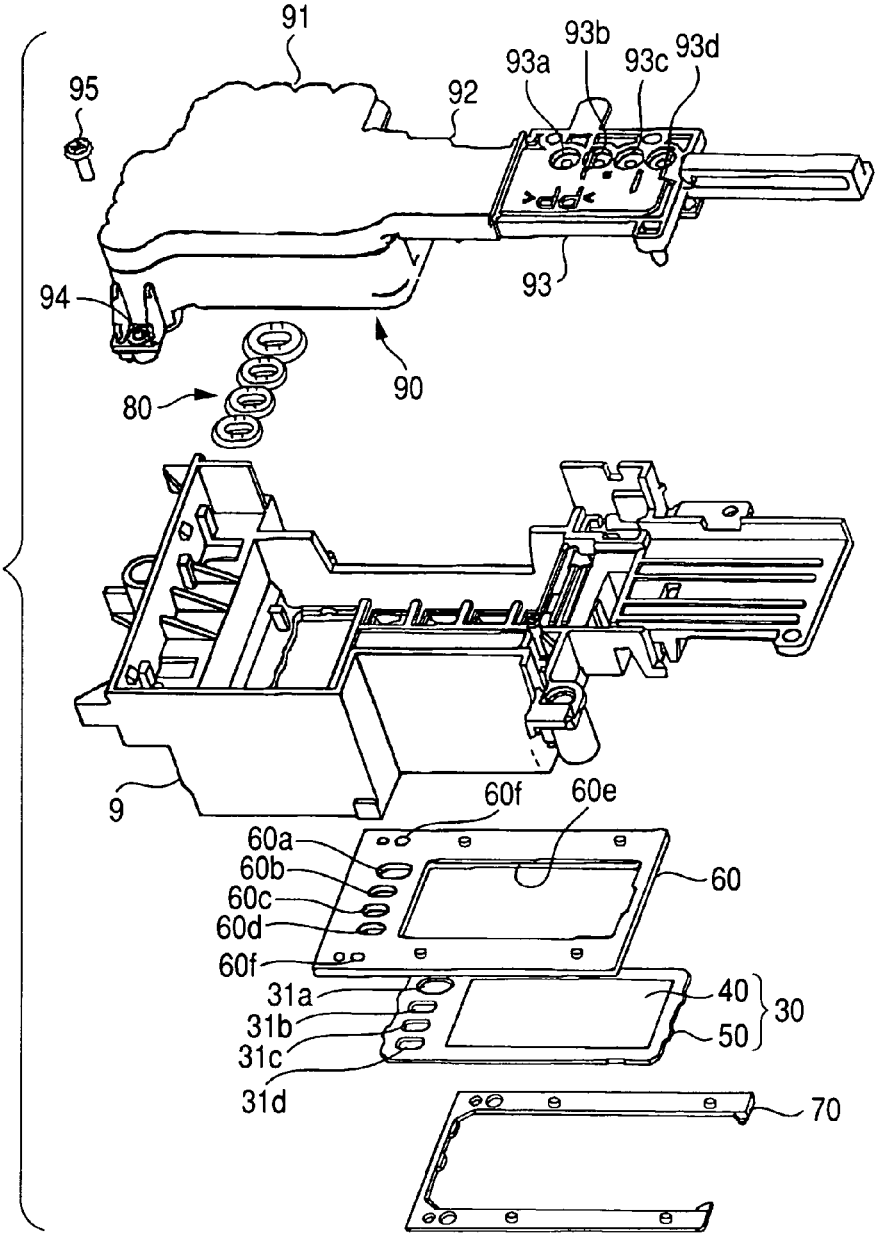
FIG. 3 is an exploded perspective view illustrating the head holder illustrated in FIG. 2 and components held by the head holder.
Figure 4:
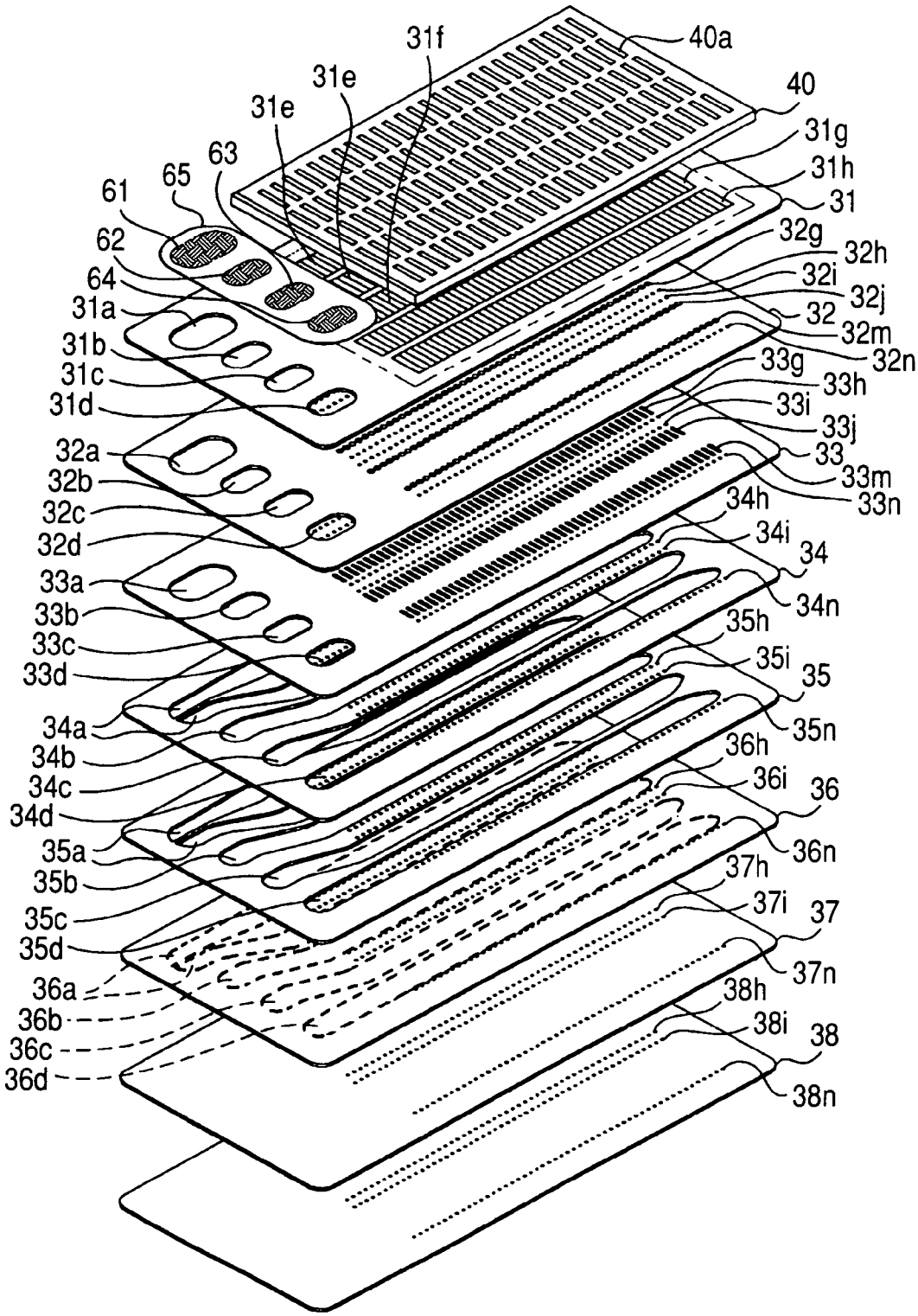
FIG. 4 is a perspective view illustrating members constituting the head unit held by the head holder illustrated in FIG. 3.
Figure 5:
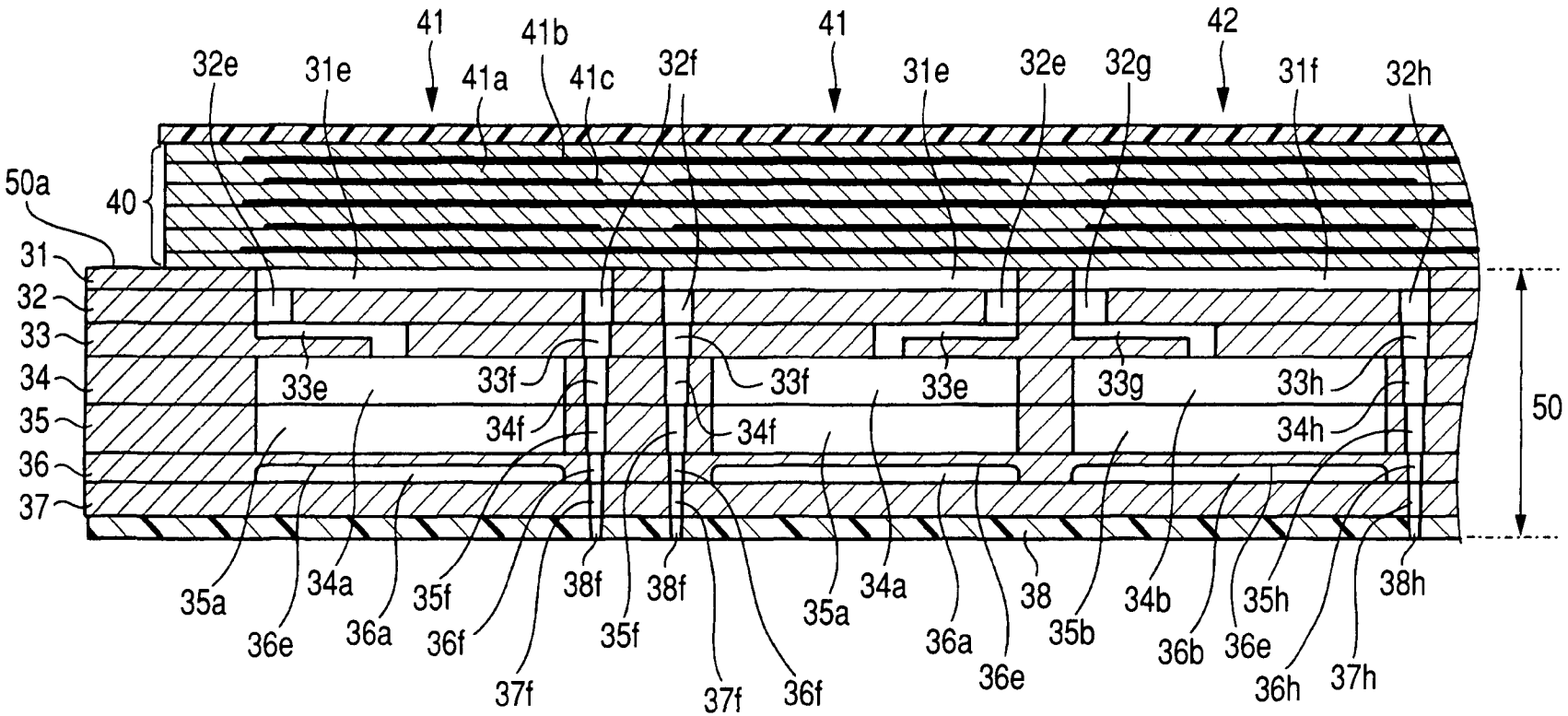
FIG. 5 is a partially sectional view illustrating the head unit taken along the arrow V-V, which is held by the head holder illustrated in FIG. 2.
Figure 6:
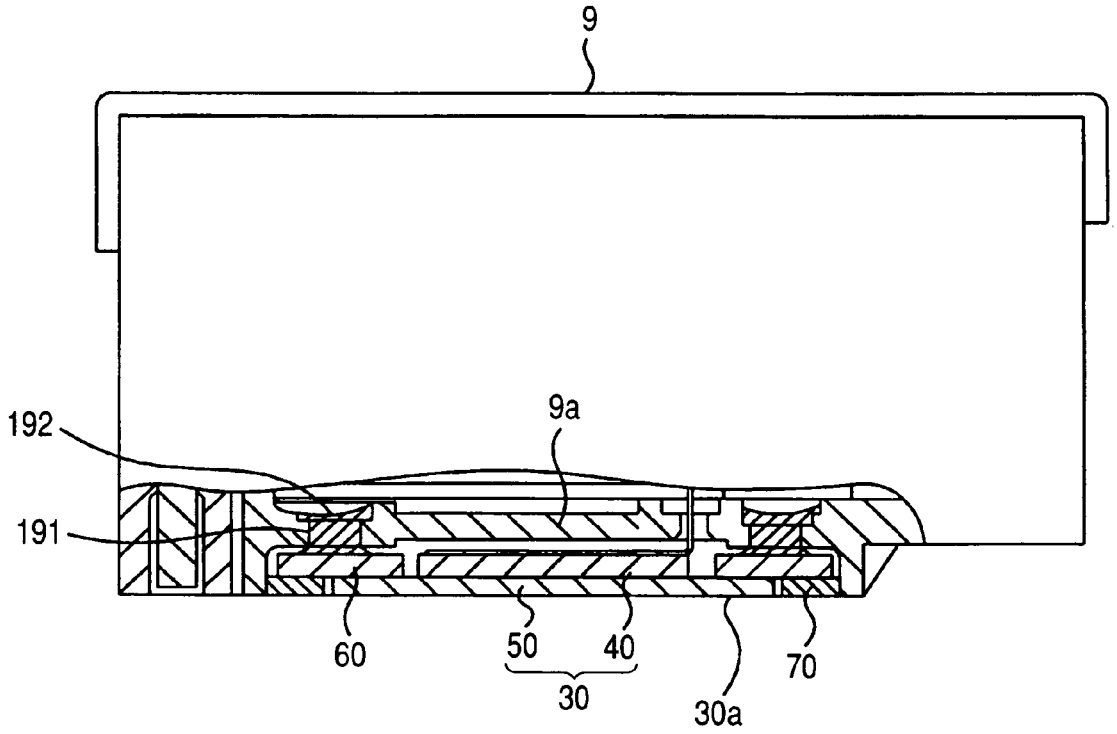
FIG. 6 is a partially sectional view illustrating the head holder taken along the arrow V-V.

FIG. 2 is a top view illustrating the head holder 9 when viewed from a nozzle surface. FIG. 3 is an exploded perspective view illustrating the head holder 9 illustrated in FIG. 2 and components held by the head holder. FIG. 4 is a perspective view illustrating members constituting the head unit held by the head holder 9 illustrated in FIG. 3. FIG. 5 is a partially sectional view illustrating the head unit taken along the arrow V-V, which is held by the head holder 9 illustrated in FIG. 2. FIG. 6 is a partially sectional view illustrating the head holder taken along the arrow V-V in FIG. 2.

In the following description, an ink ejecting direction refers to a downward direction. In addition, the same reference numbers are given to the same components as the related-art head unit and the like illustrated in FIGS. 9, 10A and 10B, and the description will be omitted.

As shown in FIG. 2, the head unit 30 includes a nozzle surface 38*p* at lower surface thereof. The nozzle surface 38*p* includes nozzles 38*f* for ejecting black ink, nozzles 38*h* for ejecting yellow ink, nozzles 38*i* for ejecting cyan ink, and nozzles 38*n* for ejecting magenta ink. The nozzles are arranged in a row shape so as to extend in a direction perpendicular to a movement direction (main scanning direction) of the head holder 9. The nozzles are opened downward so as to face the upper surface of a printing sheet P (FIG. 1), which serves as a recording medium.

Figure 9:
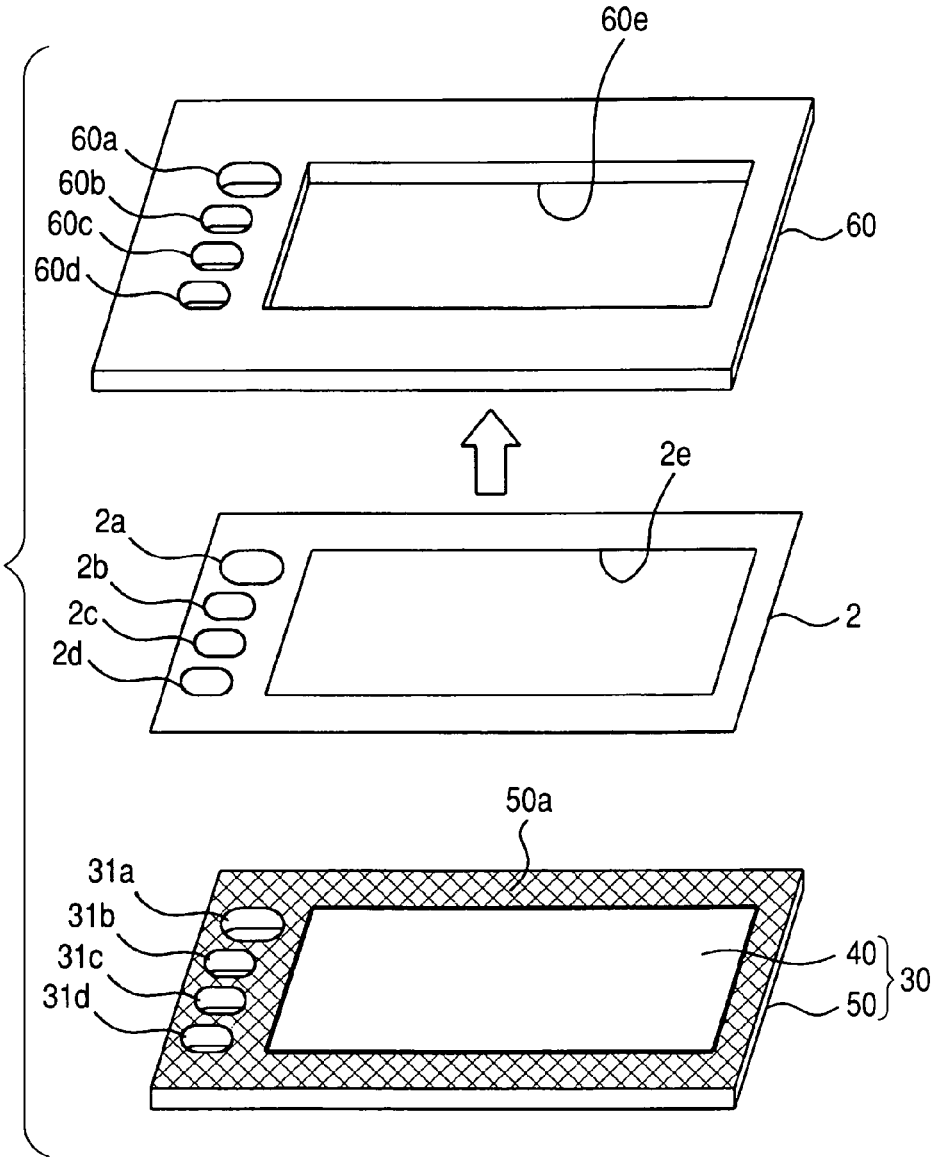
FIG. 9 is a diagram for explaining a head unit and a reinforcing plate included in a related-art ink-jet printing apparatus.
Figure 10A:
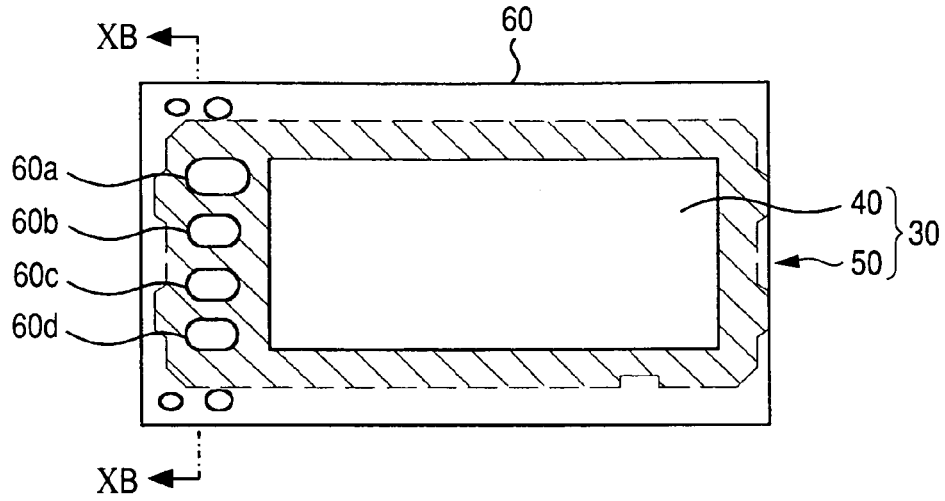
FIGS. 10A and 10B are diagrams for explaining a configuration of the related-art head unit and the related-art reinforcing plate.
Figure 10B:
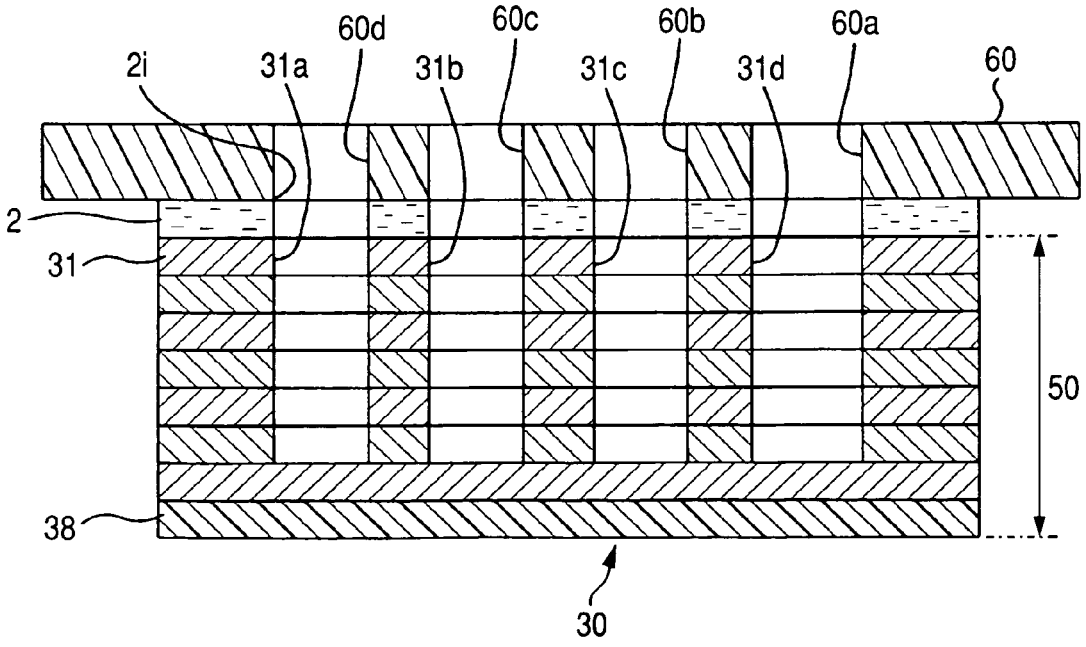

As shown in FIG. 3, a frame-shaped reinforcing plate 60 is adhered on an upper surface of the head unit 30 by a sheet-shaped adhesive (which is denoted by Reference Numeral 2 in FIGS. 9 and 10B). In addition, the head unit 30 is surrounded by a frame 70. The frame 70 is adhered on a lower surface of the reinforcing plate 60 by the sheet-shaped adhesive (not shown). The reinforcing plate 60 is fixed on a lower surface of a bottom wall 9*a* of the head holder 9 while the reinforcing plate 60 is adhered on (holding) the head unit 30. As shown in FIG. 6, a fixing operation is performed by flowing an adhesive 192 into a plurality of openings 191 of the bottom wall 9*a*.

A buffer tank 90 which stores ink supplied to the head unit 30 is disposed above the head unit 30. A predetermined amount of air exists inside the buffer tank 90. The air reduces impact generated when the head unit 30 is moved or stopped. In this way, variation of a pressure inside each pressure chamber in the head unit can be prevented, thereby maintaining a capability of uniformly ejecting ink through the nozzles. Air more than the predetermined amount separated from ink is discharged to the outside through a discharge portion 91 provided with the buffer tank 90.

An arm portion 92 which includes an ink flow path therein is formed on the end portion of the buffer tank 90. The arm portion includes ink intake ports 93*a* to 93*d* which receive ink supplied from the ink tanks 5*a* to 5*d* (FIG. 1) through tubes 14*a* to 14*d*. The buffer tank 90 includes ink supply holes (not shown) of the respective color ink at a lower surface thereof. The ink supply holes are for supplying the ink contained in the buffer tank 90 to the head unit 30. Rubber bushes 80 are interposed between the ink supply holes and the ink supply holes 60*a* to 60*d* of the reinforcing plate 60. The rubber bushes provide a liquid-tight property between the buffer tank 90 and the reinforcing plate 60.

The buffer tank 90 includes insertion holes 94 (Actually, another insertion hole 94 exists on an opposite side of the shown insertion hole 94) on both sides thereof. Attachment screws 95 inserted into the insertion holes 94 are inserted into screw holes 60*f* formed in the reinforcing plate 60. In this way, the buffer tank 90 is fixed to the reinforcing plate 60.

As shown in FIG. 5, the head unit 30 is formed in a flat plate shape by attaching a piezoelectric actuator 40 to the upper surface of a cavity unit 50. As shown in FIG. 4, the cavity unit 50 has a structure in which the total eight plates of a nozzle plate 38, a spacer plate 37, a damper plate 36, manifold plates 35 and 34, a supply plate 33, a base plate 32, and a cavity plate 31 are laminated and each attached with adjacent plate, in order from the lower side. Each of the plates is a thin plate member and the plates are adhered by an adhesive (not shown) therebetween.

In this exemplary embodiment, for example, a thermosetting epoxy resin is used as adhesive. The nozzle plate 38 of the plates is made of a synthetic resin such as polyimide. The other plates are made of a metal material such as 42 alloy steel (42% nickel alloy steel) or stainless steel which can be etched.

As shown in FIG. 5, the piezoelectric actuator 40 includes active portions 41, 41 which generate energy for ejecting black ink and an active portion 42 which generates energy for ejecting yellow ink. As not illustrated in FIG. 5, actually, active portions which generate energy for ejecting cyan ink are formed on the right side of the active portion 42. In addition, active portions which generate energy for ejecting magenta ink are formed on the right side of the active portions which generate the energy for ejecting cyan ink. Herein, the active portions in the piezoelectric actuator refer to a portion used to apply an ejecting pressure to the ink contained in the pressure chamber.

The piezoelectric actuator 40 has a structure in which piezoelectric sheets made of a piezoelectric material and film-shaped electrodes are alternatively laminated. Each of the active portions 41 includes a part of the piezoelectric sheet 41*a* interposed between electrodes 41*b* and 41*c*. The other active portions are configured in the similar manner.

Pressure chambers are formed below the active portions and in the cavity plate 31. That is, pressure chambers 31*e* for applying the ejecting pressure to black ink are formed below a plurality of the active portions 41, respectively, and in the cavity plate 31. The pressure chambers 31*e* are arranged in two rows. Likewise, pressure chambers 31*f* for applying the ejecting pressure to yellow ink are formed below a plurality of the active portions 42, respectively. The pressure chambers 31*f* are arranged in a row. Pressure chambers 31*g* (FIG. 4) for applying the ejecting pressure to cyan ink and pressure chambers 31*h* for applying the ejecting pressure to magenta ink are formed below the other active portions, respectively. The pressure chambers 31*g* and the pressure chambers 31*h* are arranged in rows, respectively.

Common ink chambers for supplying ink to the pressure chambers are formed below rows of the pressure chambers. The common ink chambers are formed in the manifold plates 35 and 34. Each of the common ink chambers is formed so as to have a length corresponding to the entire length of the rows of the pressure chambers. Specifically, common ink chambers 35*a*, 34*a* which contain black ink are formed below the rows of the pressure chamber 31*e* and in the manifold plates 35 and 34. Common ink chambers 35*b*, 34*b* which contain yellow ink are formed below the row of the pressure chamber 31*f* and in the manifold plates 35 and 34. Common ink chambers 35*c*, 34*c* (FIG. 4) which contain cyan ink are formed below the row of the pressure chamber 31*g* and in the manifold plates 35 and 34. Common ink chambers 35*d*, 34*d* which contain magenta ink are formed below the row of the pressure chamber 31*h* and in the manifold plates 35 and 34.

The supply plate 33 is disposed above the common ink chambers 34*a* to 34*d*. Narrowing portions 33*e*, 33*g*, 33*j*, and 33*m* corresponding to the pressure chambers are formed in the supply plate 33. The narrowing portions are formed in a groove shape along a flat surface of the upper portion of the supply plate 33. One end portion of each narrowing portion, which serves as an ink inflow portion, is communicated with the corresponding common ink chamber through a communication hole formed through the supply plate 33 in the upward and downward direction.

The base plate 32 is laminated above the supply plate 33. The base plate 32 covers the groove shape of each narrowing portion. In the base plate 32, communication holes 32*e*, 32*g*, 32*j*, and 32*m* are formed through the based plate 32 in the upward and downward direction. Each of the pressure chambers is communicated with the other end portion of the corresponding narrowing portion, which serves as an ink outflow portion, through the corresponding communication hole.

A cross section of each narrowing portion is formed to be smaller than that of each pressure chamber and common ink chamber communicated with the narrowing portion. Consequently, flow resistance of the narrowing portions is set to be larger than that of the common ink chambers and the pressure chambers. That is, the narrowing portions reduce a component of pressure vibration which is generated in the pressure chamber communicating the narrowing portions and is directed to the common ink chambers.

At positions corresponding to the common ink chambers, damper chambers 36*a* to 36*d* are formed in the lower surface of the damper plate 36. The damper chambers are formed so as to be opened downward in the lower surface of the damper plate 36. A shape of a transverse section of each damper chamber is formed in similar to that of a transverse section of the lower surface of each common ink chamber adjacent to the damper plate 36 (FIG. 4).

The damper plate 36 is made of a material such as a flexibly deformable metal. Thin plate-shaped lower plate portions 36*e* of the upper portion of the damper chambers can vibrate in both the common ink chambers and the damper chambers. Even when a pressure variation generated in the pressure chambers propagates to the common ink chambers in an ejecting operation of ink droplets, the lower plate portions 36*e* vibrate so as to be elastically deformed. In this way, a damper property of absorbing and damping the pressure variation can be obtained. Furthermore, crosstalk in which a pressure variation propagates in a pressure chamber to other chambers can be reduced.

Through-holes for flowing ink contained in the pressure chambers are formed so as to be communicated with each other in the upward and downward directions through the plates 32 to 37 between the cavity plate 31 and the nozzle plate 38. That is, through-holes 32*f* to 37*f* for flowing the black ink contained in the pressure chamber 31*e* to the nozzles 38*f* are formed in the upward and downward directions so as to be communicated with each other. Through-holes 32*h* to 37*h* for flowing the yellow ink contained in the pressure chamber 31*f* to the nozzles 38*h* are formed in the upward and downward directions so as to be communicated with each other. Through-holes 32*i* to 37*i* for flowing the cyan ink contained in the pressure chamber 31*g* to the nozzles 38*i* are formed in the upward and downward directions so as to be communicated with each other. Through-holes 32*n* to 37*n* for flowing the magenta ink contained in the pressure chamber 31*h* to the nozzles 38*n* are formed in the upward and downward directions so as to be communicated with each other.

As shown in FIG. 4, ink supply holes 31*a* to 31*d* for supplying each ink from the buffer tank 90 (FIG. 3) to the corresponding common ink chamber are formed in the upward and downward directions in the cavity plate 31. Through-holes 32*a* to 32*d* and through-holes 33*a* to 33*d* for communicating the common ink chambers 35*a* to 35*d* corresponding to the ink supply holes 31*a* to 31*d* are formed in the base plate 32 and the supply plate 33, respectively. The ink supply holes 31*a* to 31*d* of the cavity plate 31 are covered with filter members 65 which have filters 61 to 64 for filtering impurities contained in each ink, respectively. The filter members 65 are made of nickel. The filters 61 to 64 and the frame portions of the filters are integrally manufactured by an electroforming process.

Next, a manufacturing process will be discussed. At first, total eight plates from the cavity plate 31 to the nozzle plate 38 are laminated and adhered with the adjacent plates by a thermosetting epoxy resin. Next, the filter members 65 are laminated and adhered on the cavity plate 31 with a thermosetting epoxy resin while matching the ink supply holes 31*a* to 31*d* of the cavity plate 31 with the filters 61 to 64. The sheet-shaped adhesive 2 is aligned on the lower surface of the reinforcing plate 60, pressed to the reinforcing plate 60 and heated, thereby the sheet-shaped adhesive 2 are temporarily transferred to the reinforcing plate 60. Next, the ink supply holes 31*a* to 31*d* of the head unit 30 and the ink supply holes 60*a* to 60*d* of the reinforcing plate 60 are aligned. Then, the reinforcing plate 60 is adhered on an upper surface 50*a* of the cavity plate 31. Next, when the head unit 30 is pressed onto the reinforcing plate 60 through the sheet-shaped adhesive 2 and the sheet-shaped adhesive 2 is heated, the sheet-shaped adhesive 2 is melted and pressed. Then, the reinforcing plate 60 and the head unit 30 are fixedly adhered with each other by the sheet-shaped adhesive 2 hardened through a cooling operation.

A thickness of the sheet-shaped adhesive 2 in a state where the reinforcing plate 60 and the head unit 30 are fixedly adhered with each other is preferably in the range from 20 μm to 50 μm. In this way, when the reinforcing plate 60 and the head unit 30 are integrated, rigidity of the head unit 30 is provided. According to an experiment carried out by the inventors of this application, with the thickness of the sheet-shaped adhesive 2 in the above range, when the piezoelectric actuator 40 is driven at an ejection period, resonance of the head unit 30 was not generated, and crosstalk can be prevented so that a stable ejection state could be obtained.

[Experiment Details]

The inventors of this application carried out an experiment on a relationship between a work of adhesion of an ink to adhesion surfaces of the head unit 30 and the reinforcing plate 60, and whether detachment of the sheet-shaped adhesive 2 is generated.

In this experiment, as the reinforcing plate 60, three types of Material 1 to 3 were used. Material 1 is a reinforcing plate made of SUS 430, a surface of which is subjected to nickel processing. Material 2 is a reinforcing plate made of SUS 430, which is not subjected to surface processing. Material 3 is a reinforcing plate made of another SUS 430, which is not subjected to surface processing. It is assumed that Material 2 and Material 3 are different in impurities. Therefore, a surface energy is varied between the Material 2 and Material 3.

On the other hand, as ink, four types of Ink 1 to Ink 4 as shown in FIG. 7B were used. Since entry of the ink into the adhesion surfaces is related to a dynamic surface tension γ and a contact angle θ of the ink, the relationship was examined. These types of ink are almost similar to widely used pigment ink or dye ink for ink-jet printing and adjusted to have a dynamic surface tension of around 36 mN/m. It is noted that ink usually used in ink-jet printing has a dynamic surface tension of about between 30 to 45 mN/m.

In this experiment, the sheet-shaped adhesive 2, which is made by adding various types of adhesive components to a polypropylene resin as a major component, was used. The thickness of the sheet-shaped adhesive 2 was set in the range from 20 μm to 50 μm.

Figure 11:
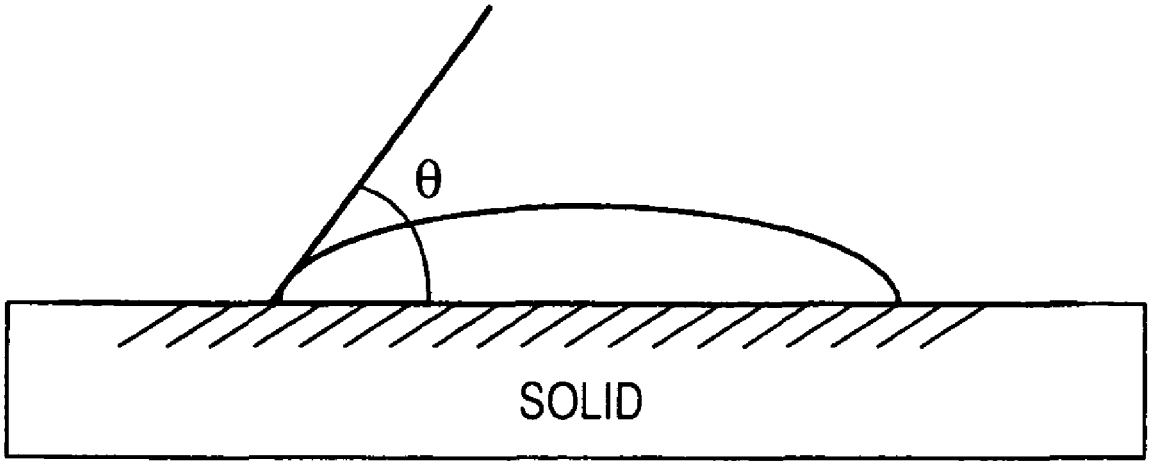
FIG. 11 is a diagram for explaining a contact angle.

A work of adhesion Wa was calculated based on the dynamic surface tension γ and the contact angle θ of the ink droplets. Herein, as shown in FIG. 11, the contact angle refers to, when a liquid of the dynamic surface tension γ is put on a solid surface, an angle formed between a tangent line drawn from an intersection point of a liquid surface and a solid surface to a liquid droplet, and the solid surface, and the angle including the liquid droplet. When it is supposed that the contact angle is θ, surface energy of a solid (surface tension) is α, an interface tension is β, $\alpha=\beta+\gamma\times\cos\theta$ is obtained from the Young formula. In this formula, γ and θ can be measured, however, β cannot be measured easily. Therefore, by using the Dupre formula (formula of work of adhesion) of $Wa=\alpha+\gamma-\beta$, the work of adhesion Wa of a liquid and a solid is expressed as $Wa=\gamma\times(1+\cos\theta)$.

Form this formula, the work of adhesion Wa can be calculated. As Wa is lager, ink is more likely to adhere to solid surface. That is, ink entry becomes more easily.

Figure 8:
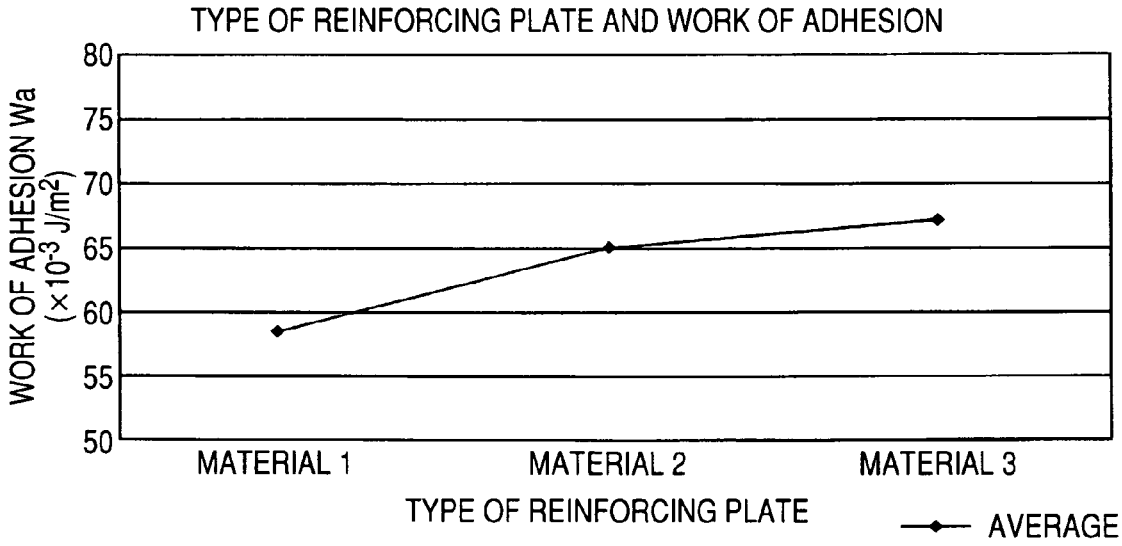
FIG. 8 is a graph based on the calculated result in FIG. 7A.

FIG. 7A is a table showing the calculated works of adhesion Wa of Ink 1 to Ink 4 to the adhesion surfaces of the reinforcing plates of Material 1 to Material 3. FIG. 8 is a graph based on the calculated result in FIG. 7A. As shown in the drawing, average values (unit: $\times10^{-3}$ J/m$^2$) of the work of adhesion Wa of Ink 1 to Ink 4 to the reinforcing plates of Material 1 to Material 3 were 58.5, 65.1, and 67.2, respectively.

In the experiment, the cavity plate 31 and the reinforcing plate of Material 1 to Material 3 adhered with each other with the filter member 65 interposed therebetween was immersed into Ink 1 to Ink 4. And it was examined whether or not Ink 1 to Ink 4 entered between the sheet-shaped adhesive and reinforcing plate.

A plurality of sets of Material 1 to Material 3 were immersed into each ink. Whether each ink entered between the sheet-shaped adhesive and reinforcing plate was examined by inserting acute blade between the reinforcing plate and the cavity plate to peel both from each other, and visually examining whether the ink entered between the sheet-shaped adhesive and reinforcing plate.

In the result, as for the reinforcing plate of Material 1, None of Ink 1 to Ink 4 entered between the sheet-shaped adhesive and the reinforcing plate, and the original adhesion strength was maintained. As for the reinforcing plate of Material 2, Ink 1 and Ink 2 did not enter between the sheet-shaped adhesive and the reinforcing plate, and Ink 3 and Ink 4 entered between the sheet-shaped adhesive and the reinforcing plate. In the case where inks entered between the sheet-shaped adhesives and the reinforcing plate, the sheet-shaped adhesives are easily detached in the course of peeling the reinforcing plate. As for the reinforcing plate of Material 3, all of Ink 1 to Ink 4 entered between the sheet-shaped adhesives and the reinforcing plate, thereby easily being detached.

From the above-described experiment, when the reinforcing plate of Material 1 was used and Ink 1 to Ink 4 were used, or the reinforcing plate of Material 2 is used and Ink 1 and Ink 2 were used, the sheet-shaped adhesive was rarely detached from the reinforcing plate. That is, as long as the reinforcing plate and ink of which the work of adhesion Wa to the adhesion surface of the reinforcing plate is $65\times10^{-3}$ J/m$^2$ (=0.065 J/m$^2$) or less are used, it is difficult for ink to enter between the reinforcing plate and the sheet-shaped adhesive, so that the sheet-shaped adhesive is rarely detached.

Note that, the sheet-shaped adhesive 2 contacted to the filter member 65 in a portion surrounding the ink flow path. However, since nickel is used for the filter member 65, the ink could not enter between the filter member 65 and the sheet-shaped adhesive 2 in the experiment result of Material 1.

Note that, as described above, the plates included in the cavity unit 50 except for the nozzles plate 38 are made of a metal material. The surface energy of the metal material is relatively large (for example, stainless: 700 to 1100 mN/m, cupper: less than 1100 mN/m and resin: less than 100 mN/m). From the surface energy of metal material, which is generally used for cavity unit 50, the work of adhesion Wa can be calculated as being $55\times10^{-3}$ J/m$^2$ (=0.055 J/m$^2$) or more.

Additionally, as shown in FIG. 7B, it is noted that the contact angle θ of ink with respect to the adhesion surface is generally larger than 40 degree when the ink did not enter between the sheet-shaped adhesive and the reinforcing plate. Further, if the contact angle θ of ink with respect to the adhesion surface is generally larger than 50 degree, all the ink did not enter between the sheet-shaped adhesive and the reinforcing plate.

Advantage of Exemplary Embodiments

As described above, if the work of adhesion Wa of the ink to the adhesion surfaces of the upper surface 50*a* of the head unit 30 and the reinforcing plate 60 is 0.065 J/m$^2$ or less, it is difficult for the ink to enter into the interface of an adhesion layer (sheet-shaped adhesive) and the reinforcing plate 60, thereby rarely peeling the reinforcing plate 60. As a result, ink mixture is rarely generated in the ink flow path. Therefore, a print quality may not deteriorate upon performing a printing operation on a recording medium. Therefore, even when a distance of the ink flow paths is shortened, the ink is not mixed in the ink flow paths, thereby reducing the size of the ink-jet printing apparatus.

Also, according to the above, since the reinforcing plate 60 is rarely detached from the adhesion layer, the head unit is reinforced by the reinforcing plate 60 so as not to be deformed or distorted, thereby stably ejecting ink droplets. When the ink-jet printing apparatus performs the printing operation on the recording medium, the print quality may not deteriorate.

Also, according to the above, since the head unit and the reinforcing plate are adhered with the adhesion layer interposed between the surfaces of the head unit and the reinforcing plate by applying a pressure, the head unit and the reinforcing plate are adhered to each other more strongly.

According to the above, since the adhesion layer is formed by the sheet-shaped adhesive, when the thickness of the adhesion layer is made to be thin by softening the sheet-shaped adhesive by means of pressing and heating, wave (distortion) in the surfaces of the plates can be absorbed and corrected.

Other Exemplary Embodiments (1) In the above-described exemplary embodiment, the adhesion surfaces of the cavity plate 50 and the reinforcing plate 60 is examined. However, the similar result is also applied to adhesion surfaces of any plates of the head unit 30.

(2) As the liquid droplet ejecting apparatus, the ink-jet printing apparatus has been described as an example. However, the present invention is not limited thereto. The similar result may be also obtained with an apparatus capable of performing coating by ejection of ink.

(3) In the above-described exemplary embodiment, an ink-jet apparatus is capable of ejecting four colors. However, the present invention is not limited thereto, and ink-jet apparatus may eject only one specific color ink to perform a printing operation.

(4) In the above-described exemplary embodiment, an ink-jet apparatus has been described as an example. However, the present invention is not limited thereto. The similar result may be also obtained with a head unit which ejects liquid droplets by using pressure variation due to bubbles generated in a liquid by applying heat energy of the liquid such as ink, or by using displacement of a vibration plate by static electricity.

(5) In the above-described exemplary embodiment, the head holder is moved along the guide shaft during a printing operation. The present invention is not limited thereto. The head holder may have a line-shaped head unit and may not be moved during a printing operation.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A liquid droplet ejecting apparatus comprising:

a plurality of plate members which are laminated with an adhesion layer interposed therebetween; and an ink flow path for an ink, which is formed through the plurality of plate members, wherein the plurality of plate members include:

a first plate member which includes a first surface; and a second plate member which is adjacent to the first plate member and includes a second surface facing to the first surface through the adhesion layer, wherein a work of adhesion of the ink to each of the first and second surfaces at a portion surrounding the ink flow path is 0.065 J/m$^2$ or less.

2. The liquid droplet ejecting apparatus according to claim 1, wherein the first plate is adhered on the second plate by applying a pressure thereto while the adhesion layer is interposed therebetween.

3. The liquid droplet ejecting apparatus according to claim 1, wherein the adhesion layer includes a sheet-shaped adhesive.

4. The liquid droplet ejecting apparatus according to claim 1, further comprising a plurality of nozzles which eject the ink.

5. The liquid droplet ejecting apparatus according to claim 1, wherein the ink includes a plurality of ink colors.

6. The liquid droplet ejecting apparatus according to claim 1, wherein a contact angle of the ink with respect to each of the first and second surfaces is generally larger than 40 degree.

7. The liquid droplet ejecting apparatus according to claim 6, wherein the contact angle of the ink with respect to each of the first and second surfaces is generally larger than 50 degree.

8. A liquid droplet ejecting apparatus comprising:

a head unit including:

a plurality of nozzles for ejecting ink; and a plurality of pressure chambers which is provided corresponding to the nozzles and which receives force from an actuator unit;

a reinforcing plate including a surface adhered on a surface of the head unit with an adhesion layer interposed therebetween;

an ink flow path for the ink, which is formed through the head unit and the reinforcing plate;

wherein a work of adhesion of the ink to each of the surface of the head unit and the surface of the reinforcing plate at a portion surrounding the ink flow path is 0.065 $J/m^2$ or less.

9. The liquid droplet ejecting apparatus according to claim 8, further comprising a head holder which holds the head unit through the reinforcing plate.

10. The liquid droplet ejecting apparatus according to claim 8, wherein the reinforcing plate is adhered on the head unit by applying a pressure thereto while the adhesion layer is interposed therebetween.

11. The liquid droplet ejecting apparatus according to claim 8, wherein the adhesion layer includes a sheet-shaped adhesive.

12. The liquid droplet ejecting apparatus according to claim 8, wherein the ink includes a plurality of ink colors.

13. The liquid droplet ejecting apparatus according to claim 8, wherein a contact angle of the ink with respect to each of the surface of the head unit and the surface of the reinforcing plate is generally larger than 40 degree.

14. The liquid droplet ejecting apparatus according to claim 8, wherein the contact angle of the ink with respect to each of the surface of the head unit and the surface of the reinforcing plate is generally larger than 50 degree.

* * * * *